US005129328A

United States Patent [19]

Donnelly

[11] Patent Number: 5,129,328

[45] Date of Patent: Jul. 14, 1992

[54] GAS TURBINE LOCOMOTIVE FUELED BY COMPRESSED NATURAL GAS

[76] Inventor: Frank W. Donnelly, UK Building, Suite 810, 409 Granville Sreet, Vancouver, British Columbia V6C 1T2, Canada

[21] Appl. No.: 706,564

[22] Filed: May 28, 1991

Related U.S. Application Data

[63] Continuation of Ser. No. 333,323, Apr. 5, 1989, abandoned.

[30] Foreign Application Priority Data

Apr. 6, 1988 [CA] Canada ..... 563406

[51] Int. Cl.[5] ..... B61C 5/00

[52] U.S. Cl. ..... 105/61.5; 105/26.05; 105/36

[58] Field of Search ..... 105/61.5, 36, 26.05; 60/39.465, 39.2, 39.33

[56] References Cited

U.S. PATENT DOCUMENTS

| | | | |
|---|---|---|---|
| 2,175,010 | 10/1939 | Anderson | 105/36 |
| 2,533,866 | 12/1950 | Yellott | 105/36 |
| 2,637,277 | 5/1953 | Altorfer | 105/36 |
| 2,826,038 | 3/1958 | Shannon et al. | 60/39.465 |
| 3,623,317 | 11/1971 | Foster-Pegg | 60/39.465 |
| 3,862,604 | 1/1975 | Pelabon | 105/61.5 |
| 4,087,961 | 5/1978 | Avery | 60/39.465 |

FOREIGN PATENT DOCUMENTS

| | | | |
|---|---|---|---|
| 0893959 | 10/1953 | Fed. Rep. of Germany | 105/36 |
| 0015917 | 2/1977 | Japan | 60/39.465 |
| 0043928 | 3/1984 | Japan | 60/39.465 |
| 0085541 | 5/1986 | Japan | 60/39.465 |
| 0265231 | 5/1971 | U.S.S.R. | 105/36 |
| 0686918 | 9/1979 | U.S.S.R. | 105/61.5 |

*Primary Examiner*—Andres Kashnikow
*Assistant Examiner*—Christopher G. Trainor

[57] ABSTRACT

A gas turbine powered locomotive. There is a gas turbine mounted on a locomotive frame. A high speed alternator is directly connected to said gas turbine. A series of rectifiers, thyristors, smoothing reactors are connected to the alternator to form a high speed electric traction generator. Traction motors are connected by means of a power controller, for controlling engine loading to the generator for driving a number of axles on the locomotive. Gas storage tanks are located on the locomotive frame.

1 Claim, 2 Drawing Sheets

GAS TURBINE LOCOMOTIVE FUELED BY COMPRESSED NATURAL GAS

This is a continuation of copending application Ser. No. 07/333,323 filed on Apr. 5, 1989, now abandoned.

FIELD OF THE INVENTION

This invention relates to locomotives and more particularly to a gas turbine locomotive.

DESCRIPTION OF THE PRIOR ART

Although tried by many railroads worldwide, the gas turbine has long since been discarded for powering everything on the rails but a few light-weight, high speed rail passenger vehicles. Gas turbines have always had stiff competition from the ever improving, fuel efficient, diesel engine and the lure of railway electrification. However, it has been realized that the gas turbine becomes an attractive alternative for providing tractive power to certain rail transportation applications. In view of the large supply of natural gas currently available and the need for more powerful locomotives, the use of a gas turbine locomotive fueled by natural gas would be an attractive motive power option to many railroads.

It has been found that a high power density gas turbine can very well be adapted in a limited space environment. Also, it has been found that a high speed alternator is equally well suited in physical size for its relative power conversion capacity. Furthermore, since the high speed alternator is able to run directly from the gas turbine without a gearbox—which is space consuming and energy robbing—greater space saving and efficiency is achieved with the gearbox deletion.

In addition to the power density aspect of the gas turbine and complementary high speed alternator, a number of attributes have been found to make this power producing equipment attractive in rail transport for the application being considered. Gas turbines have the ability to run intermittently, and they have a long service life with a relatively small maintenance requirement. The gas turbine's simplicity is a further advantage.

With the implementation of a gas turbine and high speed alternator, it is possible to have a very compact and powerful power supply for a locomotive. This power supply would be the prime source of power in a locomotive.

SUMMARY OF THE INVENTION

Accordingly, the present invention provides a gas turbine powered locomotive, comprising: a gas turbine mounted on a locomotive frame; a high speed alternator directly connected to said gas turbine; a series of rectifiers, thyristors and smoothing reactors connected to said alternator to form a high speed electric traction generator with a means of power controlling for engine loading; traction motors connected to said traction generator for driving a number of axles on said locomotive; and gas storage means on said locomotive frame for fueling said gas turbine.

DESCRIPTION OF THE DRAWINGS

Particular embodiments of the invention will be understood in conjunction with the accompanying drawings in which.

DESCRIPTION OF THE PREFERRED EMBODIMENTS

Figures 1A, 1B, 1C:
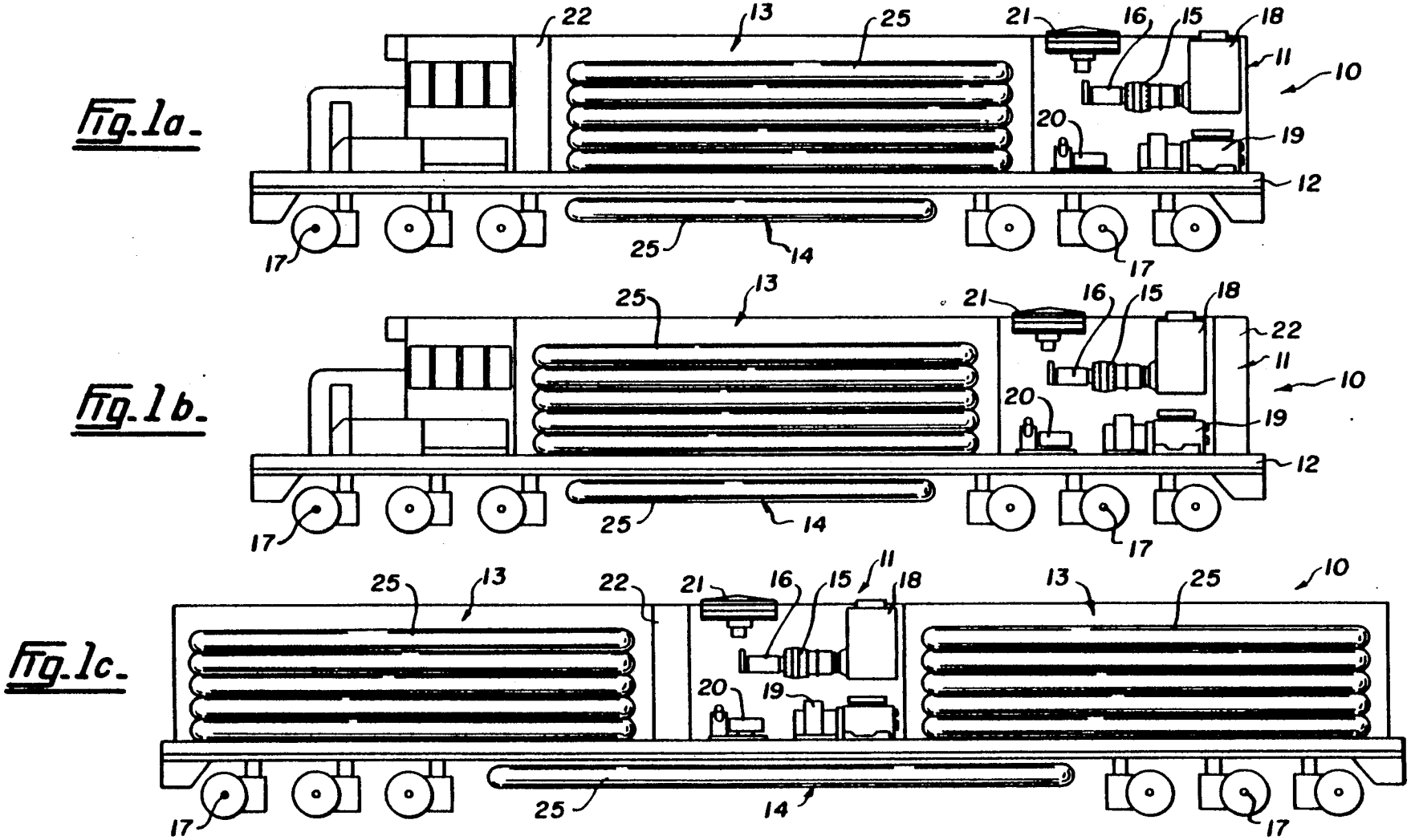
FIGS. 1*a* to 1*c* are illustrative views of various layouts of the gas turbine locomotive according to the present invention.

As depicted in FIGS. 1*a* to 1*c*, the power producing area 11 on frame 12 of the locomotive 10, is relatively small. Accordingly, the remaining space can be used to store fuel such as shown at 13 and 14. The power producing area 11 comprises a gas turbine 15 directly coupled to a high speed alternator 16 which, when connected to a series of rectifiers, thyristors and smoothing reactors, forms a high speed electric traction generator. The generator is used to supply DC power to each traction motor located on each axle 17. The exhaust silencer 18, auxiliary power unit 19, air compressor 20 and dynamic hole grids and fan 21 form the remaining components of the locomotive. The locomotives of FIGS. 1*a* and 1*b* differ, in that the high voltage power cabinets 22 are located forwardly and rearwardly, respectively, depending on weight distribution.

It has been estimated that the power producing area would require less than 30% of the entire deck 12 of locomotive 10 for a 6 axle locomotive. The other 70% would be used for storing fuel such as natural gas by means of separate cylindrical containers 25. At a pressure of 3000 pounds per square inch, which is similar to the pressure currently being used in automobiles fueled by compressed natural gas, approximately the equivalent of 4000 U.S. gallons of No. 2 diesel fuel could be stored. This 4000 gallon equivalent will give the compressed natural gas fueled gas turbine powered locomotive the same range as a standard diesel locomotive with a 3000 U.S. gallon fuel tank in light of the relative thermal efficiency between the two types of engines.

Figure 2:
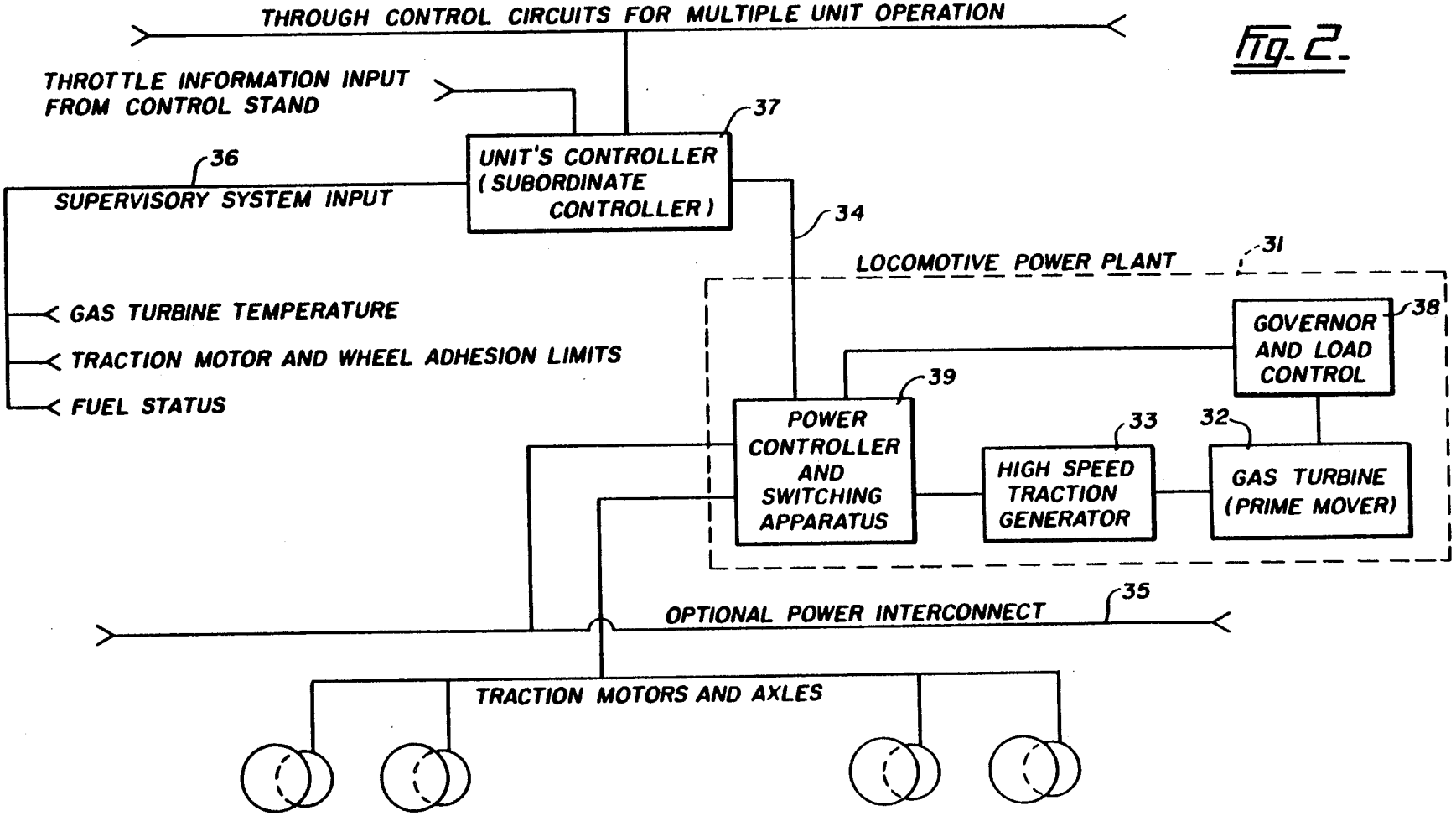
FIG. 2 is a block diagram of the gas turbine locomotive and controlling circuits.

In FIG. 2 the locomotive power plant is depicted at 31 and comprises a gas turbine 32 used as the prime mover. Various types of gas turbines can be used as indicated in the following list:

1. Sample Cycle (A) Single Spool (Shaft)
2. Regenerated Cycle (B) Two Spool (Shaft)
3. Regenerated Cycle
   With Compressor intercooling The high speed traction generator 33 would preferably include a permanent magnet synchronous alternator. However, the following would also be suitable:

wound field or rotor synchronous alternator;
homopolar generator;
induction alternator; and
switched reluctance generator.

The power control circuit 34 runs between the unit's controller 37 and power controller and switch apparatus 39. Power controller and switch apparatus 39 controls the locomotive's power output and optional power interconnect 35 with an adjacent unit.

A supervising system circuit 36 runs from a series of supervisory sensors to a unit controller 37. These sensors, which detect such variables as gas turbine temperature, traction motor and wheel adhesion limits, and fuel status, are used to collect information about the locomotive which is transmitted to the train's overall controller (not shown) by way of unit controller 37. Unit controller 37 controls all aspects of the locomotive's operation based on communication with the train's overall controller (master integrating motive power controller). Alternatively, local control of the unit is possible from the unit's control stand. This arrangement allows the gas turbine locomotive of the present invention to be employed as a single unit or joined to one or more other locomotives to create a multiple unit power consist. Optional power interconnect 35 and a control circuit are provided to allow for electrical power and controller information to pass between various units in the multiple unit train. Therefore, the electrical power of the gas turbine locomotive can be used to power the traction motors of any additional units connected in a multiple unit power consist. If operating independently of the train's controller, unit controller 37 controls locomotive function directly from the control stand.

The governor and load control 38 controls the engine speed and loading. The governor is in direct control of fuel metering in order to maintain the engine's rotational speed. The load control is in direct control of the engine loading through the power controller and in response the governor speed drops or fuel metering and engine temperature are limited.

The power controller 39 controls the locomotive power output. With direct current motor traction, a phase control or chopper circuit is used to interface power from the constant voltage output of the high speed traction generator in response to the dynamic load of the traction motors caused by varying motor speed resulting in varying amounts of back emf. Both the phase control and chopper circuits use rectifiers, thyristors and filtering. On alternating current traction motors (induction or synchronous) a cycloconverter is preferred over an inverter because of simplicity and efficiency. The relatively high frequency alternating current from the high speed traction generator is an ideal source of power for a cycloconverter to control a series of AC traction motors.

It is estimated that this type of locomotive can reduce fuel cost by at least 50%. This is based on comparing the current and historical cost of natural gas and diesel fuel.

Maintenance costs are also greatly reduced. The gas turbine can run intermittently and has a long service life. Overhauls would be relatively simple due to the ease of removal and reinstallation of the engine and traction generator. In terms of acquisition costs an estimate of the unit would be comparable to its diesel counterpart and less if the units were built up from scrapped locomotives which have serviceable parts.

A gas turbine such as General Motors Allison Model 501KB5, can produce 5278 gross horsepower at 15# C. With high speed alternator and exhaust silencer this prime power source can fit in less than 20 feet of space on the deck 12 of locomotive 10.

The high speed alternator used for generator 16 can be a permanent magnet synchronous alternator providing superior power density, efficiency and overall ruggedness.

I claim:

1. A compressed natural gas locomotive powered by a compact gas turbine, comprising:

a gas turbine mounted on a locomotive frame;

a high speed alternator directly connected to said gas turbine;

a series of rectifiers, thyristors, smoothing reactors connected to said alternator to form a high speed electric traction generator;

traction motors connected by means of a power controller for controlling engine loading to said traction generator for driving a number of axles on said locomotive;

means for connection to additional locomotive units that each include a gas turbine to form a multiple unit combination including means for independently controlling each of said additional units such that each of said gas turbines is capable of operating in an on-off mode at substantially full output in order to drive said multiple unit combination; and gas storage means on said locomotive frame comprising natural gas containers laid along the length of said frame.

* * * * *